US010665944B2

(12) United States Patent
Tanaka et al.

(10) Patent No.: US 10,665,944 B2
(45) Date of Patent: May 26, 2020

(54) ANTENNA DEVICE AND METHOD FOR MANUFACTURING ANTENNA DEVICE

(71) Applicant: SUMIDA CORPORATION, Tokyo (JP)

(72) Inventors: Kei Tanaka, Natori (JP); Shuichi Kikuchi, Natori (JP); Takanobu Rokuka, Natori (JP)

(73) Assignee: SUMIDA CORPORATION (JP)

( * ) Notice: Subject to any disclaimer, the term of this patent is extended or adjusted under 35 U.S.C. 154(b) by 0 days.

(21) Appl. No.: 16/218,046

(22) Filed: Dec. 12, 2018

(65) Prior Publication Data

US 2019/0115663 A1 Apr. 18, 2019

Related U.S. Application Data

(63) Continuation of application No. 15/460,306, filed on Mar. 16, 2017, now Pat. No. 10,186,774.

(30) Foreign Application Priority Data

Apr. 13, 2016 (JP) ..... 2016-080640

(51) Int. Cl.
*H01Q 7/00* (2006.01)
*H01Q 7/08* (2006.01)
(Continued)

(52) U.S. Cl.
CPC ..... *H01Q 7/08* (2013.01); *H01Q 1/2208* (2013.01); *H01Q 1/3241* (2013.01)

(58) Field of Classification Search
CPC ..... H01Q 1/22; H01Q 1/2208; H01Q 1/32; H01Q 1/3241; H01Q 7/00; H01Q 7/06; H01Q 7/08; H01Q 11/12
See application file for complete search history.

(56) References Cited

U.S. PATENT DOCUMENTS 6,795,032 B2 * 9/2004 Ieda ..... H01Q 1/3241 343/711
7,425,929 B2 * 9/2008 Sako ..... H01Q 7/08 343/787
(Continued)

FOREIGN PATENT DOCUMENTS

EP 2093833 A1 8/2009
EP 3211713 A1 8/2017
JP 2010-161652 A 7/2010

OTHER PUBLICATIONS

Extended European Search Report for Patent Application No. EP 18207088.8 dated Mar. 15, 2019 (8 pages).
(Continued)

*Primary Examiner* — Tho G Phan
(74) *Attorney, Agent, or Firm* — Harness, Dickey & Pierce, P.L.C.

(57) ABSTRACT

An antenna device includes a core, a bobbin member having a partition, and a coil provided around the bobbin member. The coil is configured with a tight winding portion and a loose winding portion. The tight winding portion is provided between one bobbin side and the partition. The loose winding portion is provided between the other bobbin side and the partition. The loose winding portion is configured with a first winding layer and a second winding layer. A wire winding direction of the first winding layer is opposite to a wire winding direction of the second winding layer so that the wire of the first winding layer and the wire of the second winding layer cross and overlap to each other along part of the bobbin member.

18 Claims, 9 Drawing Sheets

(51) Int. Cl.
*H01Q 1/22* (2006.01)
*H01Q 1/32* (2006.01)

(56) References Cited

U.S. PATENT DOCUMENTS

| | | | | |
|---|---|---|---|---|
| 7,463,208 | B2 * | 12/2008 | Araki | H01Q 7/08 343/718 |
| 7,755,558 | B2 * | 7/2010 | Ueda | H01Q 21/24 343/728 |
| 8,754,823 | B2 * | 6/2014 | Ohara | H01Q 7/08 343/788 |
| 9,768,509 | B2 | 9/2017 | Tanaka et al. | |
| 10,038,242 | B2 * | 7/2018 | Imai | H01Q 1/3241 |
| 2011/0241957 | A1 | 10/2011 | Ohara | |
| 2014/0145904 | A1 | 5/2014 | Yoshikawa et al. | |
| 2016/0315389 | A1 | 10/2016 | Imai et al. | |

OTHER PUBLICATIONS

Extended European Search Report for EP Application No. 17165464.3, dated Aug. 29, 2017; 8 pages.

* cited by examiner

ANTENNA DEVICE AND METHOD FOR MANUFACTURING ANTENNA DEVICE

CROSS-REFERENCE TO RELATED APPLICATIONS

This application is a continuation of U.S. patent application Ser. No. 15/460,306, filed on Mar. 16, 2017, which claims priority to Japanese Patent Application No. 2016-080640, filed on Apr. 13, 2016, both applications of which are hereby expressly incorporated by reference herein in their entireties.

BACKGROUND

The present invention relates to an antenna device and a method for manufacturing an antenna device.

In the recent years, smart key systems have become quite popular in vehicles and homes. A smart key system wirelessly transmits and receives information that relates to, for example, an ID code as an electromagnetic wave. When such an ID code is collated, an owner can perform operations, for instance, to lock and unlock a door of such a vehicle or house, or to start and stop the engine without using a mechanical key. In the smart key system mentioned above, an antenna device, which has a coil antenna to transmit and receive the information, is used.

As an antenna device explained above, for instance, related technologies are disclosed in Japanese Patent Number 5050223. The antenna device that is disclosed in this Japanese Patent is configured with a first magnetic substance core, a first coil, a second magnetic substance core, and a second coil.

The first magnetic substance core is in a flat rod (bar) (rectangular bar) shape. Further, the first coil is located at an outer circumferential side of the first magnetic substance core, and one end of the first coil is connected to a first terminal. The second magnetic substance core has a toroidal closed magnetic path structure and has a configuration in which though magnetic saturation occurs at the time of the transmission of a signal radio wave, the magnetic saturation does not occur at the time of the reception of the signal radio wave. Further, the second coil is wound around the second magnetic substance core. One end of the second coil is connected to the other end of the first coil, and the other end of the second coil is connected to a second terminal.

In the configuration disclosed in Japanese Patent Number 5050223, a special magnetic substance core that is the second magnetic substance core is used, and at the same time, the second coil that is wound around the second magnetic substance core is used. As a result, a resonance frequency is adjusted. Therefore, this construction has the possibility of being complicated.

Further, in an LC (an inductor and a capacitor) resonant circuit, because a resonance frequency is defined within a narrow range, the mathematical product (L*C) of L and C (an inductor and a capacitor) can also be changed only within a narrow range. On the other hand, in regards to the first coil, a part, in which a wire is densely wound, exists. However, in that densely wound part, a change of an inductance value L per one turn can be, for instance, about 10 pH. Further, in general, a capacitor that is used in a resonant circuit also has a characteristic variation (as an example, ±5%) during manufacturing. As a result, it may become desirable to adjust an inductance value L of the first coil every 1 pH, however, this adjustment is difficult. Therefore, it becomes difficult to absorb the variation of the electrostatic capacity value C, and the variation of the product of the inductance value L and the electrostatic capacity value C, which is needed when a resonance frequency is obtained, is suppressed within a resonance range.

SUMMARY

The present invention attempts to solve these problems. An object of the present invention is to provide an antenna device and a method for manufacturing an antenna device that enable an inductance value to be easily adjusted within a narrow tolerance range in spite of a simple structure.

In order to achieve the above object, an antenna device according to one aspect of the present invention includes: a core that is formed with a magnetic material; a bobbin member that is provided at an outer circumferential side of the core, that has first and second bobbin sides opposite to each other, and that has a partition at a position located between the first and second bobbin sides; and a coil that is provided by winding a wire around the bobbin member. The coil is configured with a tight winding portion and a loose winding portion. The tight winding portion is provided around a first area of the bobbin located between the first bobbin side and the partition. The loose winding portion is provided around a second area of the bobbin located between the second bobbin side and the partition. A wiring density of the tight winding portion in which the wire is densely wound is larger than a wiring density of the loose winding portion in which the wire is loosely wound. The loose winding portion is configured with a first winding layer and a second winding layer which is formed on the first winding layer at a first part of the bobbin member. A wire winding direction of the first winding layer is opposite to a wire winding direction of the second winding layer so that the wire of the first winding layer and the wire of the second winding layer cross each other and overlap each other at the first part of the bobbin member.

An antenna device according to another aspect of the present invention further includes a terminal attachment part, to which a terminal is attachable, that is provided at one of the first bobbin side and the second bobbin side. The terminal attachment part is provided at the first bobbin side so that the tight winding portion is located closer to the terminal mounting part than the loose winding portion.

In an antenna device according to another aspect of the present invention, the wire of the first winding layer and the wire of the second winding layer are provided in a single layer along a second part of the bobbin member.

In an antenna device according to another aspect of the present invention, the bobbin member is longitudinally extended in a longitudinal direction. Both the wire of the first winding layer and the wire of the second winding layer cross a width direction perpendicular to the longitudinal direction at an angle of 3° to 177°.

In an antenna device according to another aspect of the present invention, a length of the loose winding portion in the longitudinal direction is equal to or longer than a length of the tight winding portion in the longitudinal direction.

In an antenna device according to another aspect of the present invention, a first wound wire pitch (internal) between first adjacent turns of the wire of the loose winding portion closest to the first bobbin side is different from a second wound wire pitch between second adjacent turns of the wire of the loose winding portion closest to the second bobbin side. Alternatively, the first wound wire pitch between first adjacent turns of the wire of the loose wound portion closest to the first bobbin side is longer than the second wound wire pitch between second adjacent turns of the wire of the loose wound portion closest to the second bobbin side.

In a method for manufacturing an antenna device according to another aspect of the present invention, the antenna device has: a core that is formed with a magnetic material; a bobbin member that has a core insertion part (core sleeve, core pocket, or core housing) in which of the core is provided, that has first and second bobbin sides opposite to each other, and that has a partition at a position located between the first and second bobbin sides; and a coil that is provided by winding a wire around the bobbin member. The method includes: inserting the core into the core insertion part of the bobbin; and forming the coil by winding the wire around the bobbin member. The winding includes: densely winding the wire around a first area of the bobbin located between the first bobbin side and the partition so as to form a tight would portion; and loosely winding the wire around a second part of the bobbin located between the second bobbin side and the partition so as to form a loose would portion. The loosely winding includes: forming a first winding layer by winding the wire in a first wire winding direction; and after the first winding layer is formed, forming a second winding layer by winding the wire in a second wire winding direction opposite to the first wire winding direction on the first wire at a first part of the bobbin member so that the wire of the first layer and the wire of the second layer cross each other.

In a method for manufacturing an antenna device according to another aspect of the present invention, the wire of the first winding layer and the wire of the second winding layer are provided in a single layer along a second part of the bobbin member.

In a method for manufacturing an antenna device according to another aspect of the present invention, the bobbin member is longitudinally extended in a longitudinal direction. Both the wire of the first winding layer and the wire of the second winding layer cross a width direction perpendicular to the longitudinal direction at an angle of 3° to 177°. Further, a length of the loose winding portion in the longitudinal direction is equal to or longer than a length of the tight winding portion in the longitudinal direction. A first wound wire pitch (interval) between first adjacent turns of the wire of the loose winding portion closest to the first bobbin side is different from (or longer than) a second wound wire pitch between second adjacent turns of the wire of the loose winding portion closest to the second bobbin side.

According to the above aspects of the present invention, it is possible to provide an antenna device that enables an inductance value to be easily adjusted in spite of the simple structure.

DESCRIPTION OF EXEMPLARY EMBODIMENTS

First Embodiment

An antenna device 10A according to a first embodiment of the present invention will be explained below with reference to the drawings.

Further, an XYZ orthogonal coordinate system can be used in the following embodiments. Specifically, an X-direction is defined to be a longitudinal direction of the antenna device 10A. An X1 side is defined to be a side in which a connector connection part 40A being explained below is located, and an X2 side is opposite of this X1 side. Further, a Z-direction is defined to be a thickness direction of the antenna device 10A. A Z1 side is defined to be an upper side in FIG. 2, and a Z2 side is defined to be a lower side in FIG. 2. Further, a Y-direction is defined to be a direction (a width direction) perpendicular to the X- and Z-directions. A Y1 side is defined to be a right front side in FIG. 1, and a Y2 side is defined to be a left far side that is opposite to the Y2 side.

Overall Configuration of Antenna Device 10A

Figure 1:
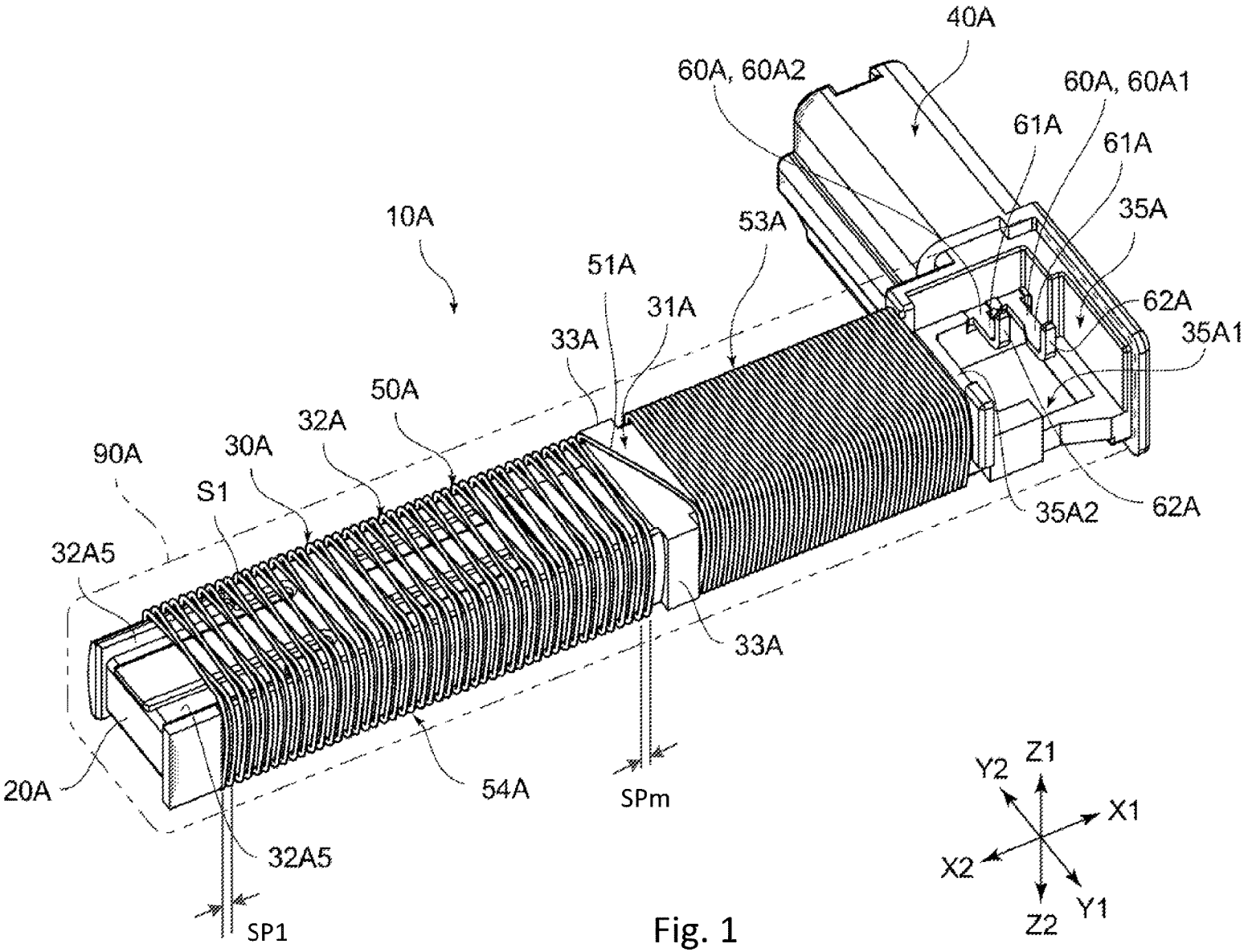
FIG. 1 is a perspective view that shows an overall configuration of an antenna device according to a first embodiment of the present invention.
Figure 2:
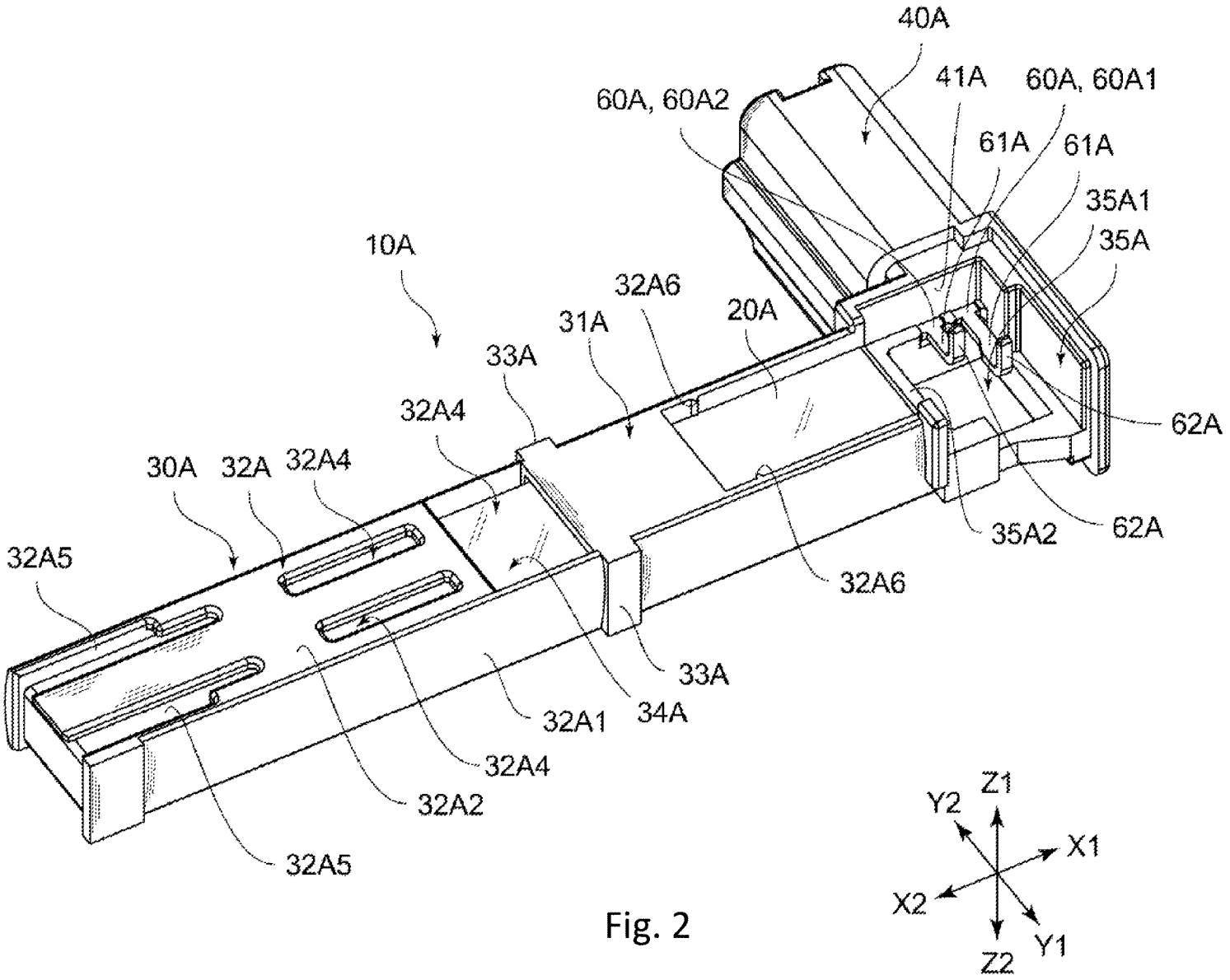
FIG. 2 is a perspective view that shows a state in which a coil is removed from the antenna device that is shown in FIG. 1 according to the first embodiment of the present invention.
Figure 3:
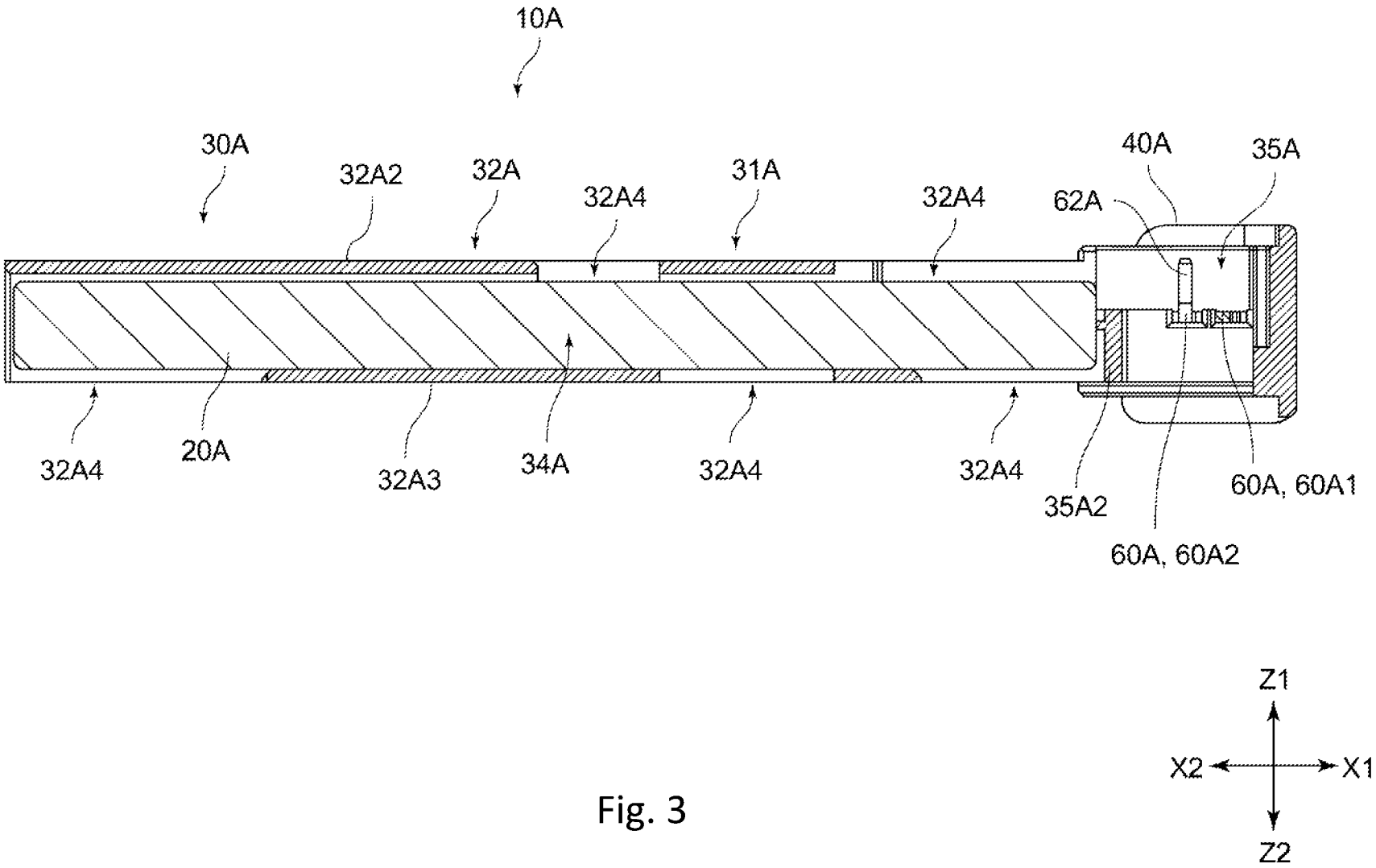
FIG. 3 is a side cross sectional view that shows a configuration of the antenna device that is shown in FIG. 1 according to the first embodiment of the present invention.

FIG. 1 is a perspective view that shows an overall configuration of the antenna device 10A. FIG. 2 is a perspective view that shows a state in which a coil 50A is removed from the antenna device 10A. FIG. 3 is a side cross sectional view that shows the configuration of the antenna device 10A. As shown in FIGS. 1-3, the antenna device 10A is configured with a core 20A, a bobbin member 30A, the coil 50A, a connection terminal 60A, and a case 90A as main components.

As shown in FIGS. 2 and 3, the core 20A is formed with a magnetic material, and at the same time, is longitudinally extended (as a rectangular bar) in the X-direction. Thus, a cross-sectional shape of the core 20A viewed from a front side is rectangular. Further, a material of the core 20A is a magnetic material. As the magnetic material, for instance, various magnetic materials, such as various ferrites like a nickel based ferrite and a manganese based ferrite, Permalloy and Sendust, and various mixtures of the magnetic materials can be used.

Further, as shown in FIG. 2, a bobbin part 31A of the bobbin member 30A is attached at an outer circumferential side of the core 20A. It is preferred that a material of the bobbin member 30A is a thermoplastics resin or a thermosetting resin which have excellent insulation properties. Further, as an example of the material that configures the bobbin member 30A, PBT (polybutylene terephthalate) can be considered, however, other materials can also be used as the material. Further, considering that there is a possibility that the bobbin member 30A could be thermally damaged by a soldering or a welding, a heat resistant resin is further preferable to be used.

Figure 4:
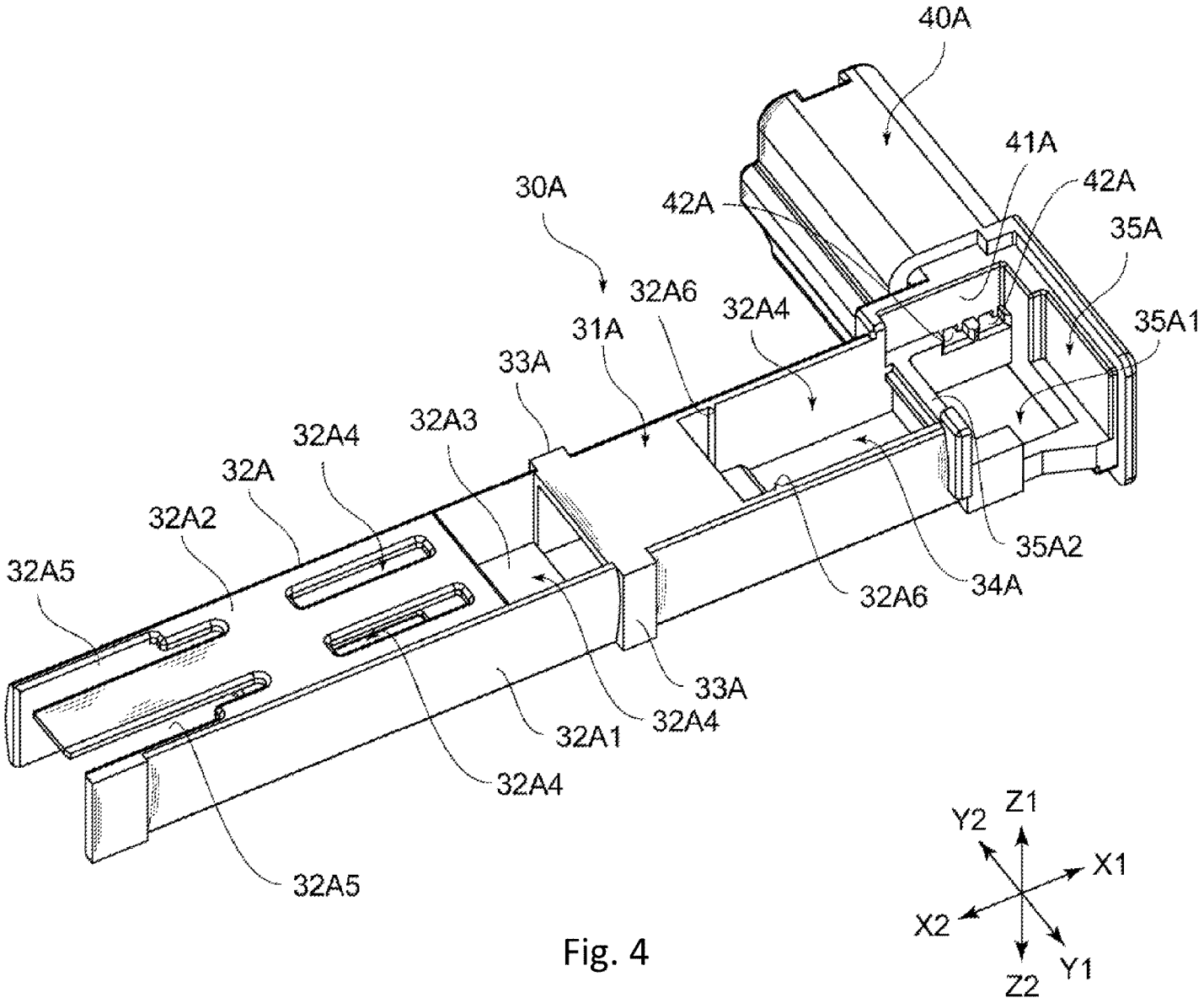
FIG. 4 is a perspective view that shows a configuration of a bobbin member of the antenna device that is shown in FIG. 1 according to the first embodiment of the present invention.

FIG. 4 is a perspective view that shows a configuration of the bobbin member 30A. As shown in FIGS. 1-4, the bobbin member 30A is configured with the bobbin part 31A, a terminal mounting (fitting or attachment) part 35A, and a connector connection part 40A. The bobbin part 31A is provided with a winding frame part 32A, a partition 33A and a core insertion part 34A (core sleeve, core pocket, or core housing).

The winding frame part 32A can have a cylindrical shape, however, in the first embodiment of the present invention, the winding frame part 32A has a shape of being suitably (partially) punched through. Specifically, as shown in FIG. 4, as the configuration, while a sidewall part 32A1 is allowed to remain, a punched part 32A4 (slot, opening, and/or elongated orifice) and a slit 32A5 are provided in a top surface 32A2 (an upper side; a Z1 side) and a bottom surface 32A3 (a lower side; a Z2 side). In particular, the slit 32A5 is provided on the other end side (the X2 side) in the longitudinal direction (the X-direction). Further, the other end side (the X2 side) of the slit 32A5 is in a released (open) state. Therefore, when a wire 51A (wire segment 51A) is wound around the winding frame part 32A in a state in which a predetermined tension is given, the core 20A that is inserted in the core insertion part 34A is windingly tighten so that the core 20A is indirectly partially held by the wound wire.

Further, the partition 33A is provided at the bobbin part 31A. The partition 33A is used for partitioning a tight winding portion 53A (tight-coil winding portion, fine winding portion or densely winding portion) and a loose winding portion 54A (loose-coil winding portion, rough winding portion or coarse winding portion) of the coil 50A. In the configuration shown in FIG. 4, the partition 33A corresponds to a projecting part that is, for instance, formed by projecting the sidewall part 32A1, however, the side of the top surface 32A2 or the side of the bottom surface 32A3 of the winding frame part 32A can also be projected.

Further, the core insertion part 34A corresponds to a hole-like part (opening or slot) that penetrates the bobbin part 31A in the longitudinal direction (the X-direction) and is also the part through which the core 20A is inserted. On an inner wall side of the sidewall part 32A1 facing the core insertion part 34A, a core holding projection 32A6 contacting the core 20A is provided. Any number of core holding projections 32A6 can be provided, however, in the configuration shown in FIG. 4, two core holding projections 32A6 are provided close to one side (the X1 side) of the longitudinal direction (the X-direction) of the core insertion part 34A. The core 20A is in the state of being held in the core insertion part 34A by the core holding projection 32A6 and the inner wall of the bobbin part 31A by being windingly tightened by the wound wire on the other end side (the X2 side).

Further, the connection terminal 60A (refer to FIGS. 1 and 2) is attached to the terminal mounting part 35A. A vertically penetrating opening 35A1 is provided at the terminal mounting part 35A, and a pair of entwining parts 62A of a pair of connection terminals 60A are exposed to the opening 35A1. Each of the entwining parts 62A is entwined with an end of the wire 51A of the coil 50A, and after the entwining, the coil 50A and the connection terminal 60A are electrically connected by, for example, soldering.

Further, a barrier wall 35A2 is provided at the other end side (the X2 side) of the terminal mounting part 35A in order to separate the terminal mounting part 35A from the core insertion part 34A. Thus, because one end of the core 20A runs against the barrier wall 35A2, the core 20A is positioned within the core insertion part 34A.

As a configuration of the terminal mounting part 35A, a substrate on which, for instance, a capacitor or a resistor is mounted can also be attached to the terminal mounting part 35A. When the substrate is attached, a part of the connection terminal 60A such as the entwining part 62A penetrates the substrate and the soldering is performed at the penetrated part. As a result, a conductor pattern of the substrate and the connection terminal 60A are electrically connected. Further, when the substrate is attached to the terminal mounting part 35A, it is preferred that a configuration in which the substrate fits into or interlocks with the terminal mounting part 35A is adopted.

Further, the connector connection part 40A is continuously provided at the terminal mounting part 35A. In the first embodiment of the present invention, the connector connection part 40A is provided along a width direction (the Y-direction) perpendicular to the longitudinal direction (the X-direction) at a right angle. This connector connection part 40A has a bottomed connector hole (e.g., a blind bore, not shown) and one end side (the Y1 side) of this connector hole is partitioned by a partition wall part 41A.

As shown in FIG. 4, a terminal hole 42A that extends in the width direction (the Y-direction) is provided at the partition wall part 41A. The connection terminal 60A is inserted into the terminal hole 42A. Therefore, the connection terminal 60A being inserted into the terminal hole 42A can project to the connector hole. Further, in the first embodiment of the present invention, because a pair of the connection terminals 60A are provided, a pair of the terminal holes 42A also exist. However, the number of terminal holes 42A can be changed as desired to correspond to the number of the connection terminals 60A.

Further, an external connector that is inserted into this connector hole is electrically connected to the connection terminal 60A that projects into the inside of the connector hole. As a result, an electric current can flow in the coil 50A explained below.

Figure 5:
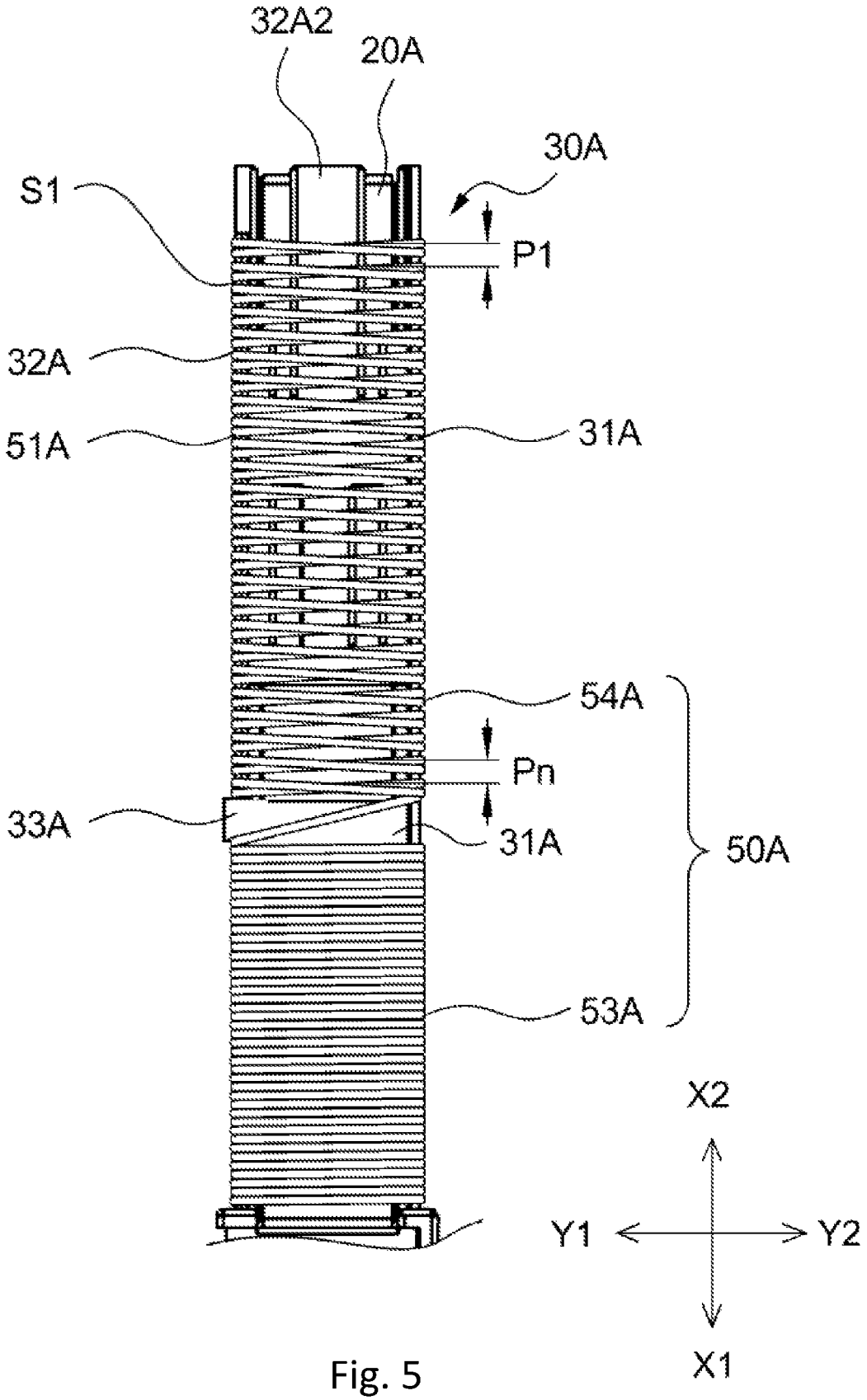
FIG. 5 is a plan view that shows a part of a bobbin, where a coil is wound, of the antenna device that is shown in FIG. 1 according to the first embodiment of the present invention.

Next, the coil 50A will be explained. FIG. 5 is a plan view that shows a portion being wound with the coil 50A in the bobbin part 31A. As shown in FIG. 5, the coil 50A is configured with the tight winding portion 53A and the loose winding portion 54A. The tight winding portion 53A is densely wound on one side (the X1 side; the side of the terminal mounting part 35A) of the longitudinal direction (the X-direction) of the winding frame part 32A of the coil 50A. On the other hand, the loose winding portion 54A is loosely wound throughout the other side (the X2 side) of the longitudinal direction (the X-direction) of the winding frame part 32A from the partition 33A as the partition 33A is a boundary.

In the configuration shown in FIG. 5, the tight winding portion 53A and the loose winding portion 54A are formed by winding the wire 51A in two layers. For instance, the winding is started from one side (the X1 side) of the longitudinal direction (the X-direction) of the winding frame part 32A, and then, after reaching the other side (the X2 side) of the winding frame part 32A, the winding is continuously performed until the wire 51A reaches (returns) one side (the X1 side) again. Therefore, the wire 51A of a lower layer (a first layer) and the wire 51A of an upper layer (a second layer) cross (intersect) each other. However, the number of stacked winding layers is not limited to two. Specifically, the tight winding portion 53A and the loose winding portion 54A can also be formed by winding the wire in a plurality of stacked winding layers such as four or six winding layers.

Further, a locking member for preventing a position shift and for supporting the wire 51A can also be adopted on the other side (the X2 side) of the winding frame part 32A. Because the wire 51A is locked on the other side (the X2 side) of the winding frame part 32A by this locking member, the wire 51A of the lower layer (the first layer) and the wire 51A of the upper layer (the second layer) can excellently cross (intersect) each other. Further, each of the wire 51A of the lower layer (the first layer) and the wire 51A of the upper layer (the second layer) can cross the width direction (the Y-direction) at an angle range of 3 degrees (3°) to 177 degrees (177°). Specifically, the width direction (the Y-direction) is perpendicular to the longitudinal direction (the X-direction) of the bobbin member 30A at right angles. In this angle range, it is possible to prevent the wire 51A of the upper layer (the second layer) from being in a state in which it remains fallen into a recess made between the adjacent turns of the wire 51A of the lower layer (the first layer). As a result, the inductance value adjustment can be easily performed.

As shown in FIG. 5, as compared with the tight winding portion 53A, a winding density of the loose winding portion 54A is low. That is, the number of windings of the wire 51A per unit length of the winding frame part 32A in the longitudinal direction (the X-direction) of the loose winding portion 54A is smaller than that of the tight winding portion 53A. Therefore, in regards to the loose winding portion 54A, there is a gap S1 that is relatively large between the adjacent turns of the wire 51A.

In regards to a wide-width surface (a XY surface) of the winding frame part 32A, intervals between the adjacent turns of the wire 51A of the loose winding portion 54A are defined as pitches P1, P2, . . . , and Pn. As shown in FIG. 5, the pitch P1 corresponds to a distance (interval) between the adjacent turns of the wire 51A that are located closest to the other end side (the X2 side) of the winding frame part 32A. Similarly, distances (intervals) between the adjacent turns of the wire 51A are sequentially defined as the pitches P2, P3, . . . , and Pn from the other end side (the X2 side) of the winding frame part 32A toward one end side (the X1 side), i.e., the partition 33A. Thus, a distance (interval) between the adjacent turns of the wire 51A that are located closest to one end side (the X1 side) (the partition 33A) of the winding frame part 32A corresponds to the pitch Pn. Of course, the pitches P1-Pn correspond to the distances (intervals) between the adjacent turns of the wire 51A of the upper layer or the distances (intervals) between the adjacent turns of the wire 51A of the lower layer. Note, however, that each of the pitches P1-Pn does not correspond to a distance (interval) between the wire 51A of the upper layer and the wire 51A the lower layer that are located adjacent to each other.

Further, in regards to a narrow-width surface (an XZ surface) of the winding frame part 32A, intervals between the adjacent turns of the wire 51A of the loose winding portion 54A are defined as pitches SP1, SP2, . . . , and SPm. See for example, FIGS. 1 and 8. The pitch SP1 corresponds to a distance (interval) between the adjacent turns of the wire 51A that are located closest to the other end side (the X2 side) of the winding frame part 32A. Similarly, distances (intervals) between the adjacent turns of the wire 51A are sequentially defined as the pitches SP2, SP3, . . . , SPm from the other end side (the X2 side) of the winding frame part 32A toward one end side (the X1 side), i.e., the partition 33A. Further, a distance (interval) between the adjacent turns of the wire 51A that are located closest to one end side (the X1 side) (the partition 33A) of the winding frame part 32A corresponds to the SPm. As explained below, in regards to a side surface (the narrow-width surface, also referred to as "the XZ surface") of the winding frame part 32A, because the wire 51A of the upper layer and the wire 51A of the lower layer are alternatively arranged on the same surface, i.e., as a single layer, the pitches SP1-SPm are the distances (intervals) between the wire 51A of the upper layer and the adjacent wire 51A of the lower layer, not the distances (intervals) between the adjacent turns of the wire 51A of the upper layer nor the distances (intervals) between the adjacent turns of the wire 51A of the lower layer.

The loose winding portion 54A has a gap S1 (see, for example, FIGS. 1 and 8) between the turns of the wire 51A, i.e., the already existing wire 51A of the lower layer and the wire 51A of the upper layer that is provided at an upper side of the wire 51A of the lower layer. Therefore, in the loose winding portion 54A, the adjustment of an inductance value can be performed by laterally (axially) moving (compressing or expanding) the wire 51A (the turns of the wire 51A) to make the gap S1 (i.e., any pitch among the pitches P1-Pn, or SP1-SPm) narrow or wide.

Specifically, it is most effective to move the pitches P1 or SP1 for adjusting an inductance value. Because the adjacent turns of the wire 51A that form the pitches P1 or SP1 are the located closest to the end of the core 20A, the influence to distribution of a magnetic flux being generated by the end of the core 20A is the greatest. Similarly, the influence to the distribution of the magnetic flux of the adjacent turns of the wire 51A that form the pitches P2 or SP2 is the second greatest. On the other hand, the influence to the distribution of the magnetic flux of the adjacent turns of the wire 51A that form the pitches Pn or SPm is the smallest, and in general, the wires 51A (the turns of the wire 51A) are not moved or a pitch length of them is not changed. Therefore, a pitch length of the pitch P1 is different from a pitch length of the pitch Pn.

Further, with respect to a fine adjustment of an inductance value, it is acceptable that only the very first wire 51A from the other end side (the X2 side) of the winding frame part 32A is moved. Therefore, in this case, only the pitch SP1 changes, and the other pitches SP2-SPm and the pitches P1-Pn are not changed. In other words, in this case, a length of the pitch SP1 is different from a length of the pitch SPm, however, a length of the pitch P1 is the same as a length of the pitch Pn.

Further, as explained above, the lengths of the pitches P1-Pn or the pitches SP1-SPm can be lengthened or shortened (expanded or compressed) in order to adjust an inductance value. However, it is preferred to shorten a length of each pitch. That is, it is preferred that the length of the pitch P1 is shorter than the length of the pitch Pn, or the length of the pitch SP1 is shorter than the length of the pitch SPm.

Figure 6:
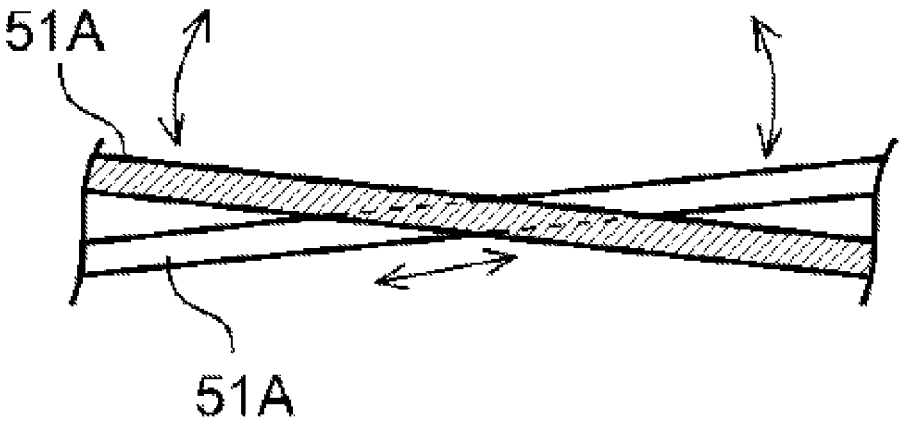
FIG. 6 is an enlarged plan view that shows a wound state of a lower layer wire and an upper layer wire of the antenna device according to an embodiment of the present invention.
Figure 7:
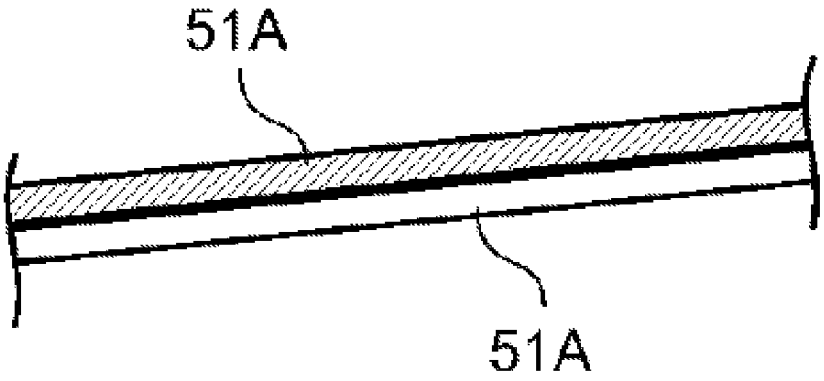
Fig. 7 Related Art
FIG. 7 is an enlarged plan view that shows a wound state of a lower layer wire and an upper layer wire of an antenna device as a comparative example.

Further, the wire 51A of the lower layer and the wire 51A of the upper layer are wound so as to cross each other. Therefore, the wires 51A (the turns of the wire 51A) of the upper layer are easier to move than the wires 51A (the turns of the wire 51A) of the lower layer. This configuration is shown in FIGS. 6 and 7. FIG. 6 is an enlarged plan view that shows a wound state of the wire 51A of the upper and lower layers of the antenna device 10A according to the first embodiment of the present invention. FIG. 7 is an enlarged plan view that shows a wound state of wire of upper and lower layers of an antenna device as a comparative example.

As shown in FIG. 6, when the wires 51A (the turns of the wire 51A) of the lower layer and the wires 51A (the turns of the wire 51A) of the upper layer cross (intersect) each other, the wires 51A (the turns of the wire 51A) of the upper layer rarely fall into the recess made between the adjacent turns of the wire 51A of the lower layer, and slide while they are mounted on the wires 51A (the turns of the wire 51A) of the lower layer. At this time, the wire 51A of the upper layer is slid in a state in which a contact area with respect to the wire 51A of the lower layer is small.

On the other hand, as shown in FIG. 7, when the wire 51A of the lower layer and the wire 51A of the upper layer are wound in the same direction without crossing, the wire 51A of the upper layer tends to fall into the recess made between the adjacent turns of the wire 51A of the lower layer. Similarly, another wire 51A, which is adjacent to the wire 51A (of the upper layer) mentioned above, of the upper layer also falls into another recess. Therefore, when the wire 51A of the upper layer slides relative to the wire 51A of the lower layer, the targeted wire 51A of the upper layer and near portions of that wire 51A of the upper layer including an adjacent part must be raised to a top of the wire 51A of the lower layer from the recess. Therefore, it is very difficult to slide the wire 51A of the upper layer.

Next, the connection terminal 60A will be explained. The connection terminal 60A shown in FIGS. 1-3 is formed to be in an approximate L-shape by performing the press-forming to a metal terminal. The connection terminal 60A explained above is provided so that an external appearance has the approximate L-shape. In order to form this approximate L-shape, the connection terminal 60A is bent in order to form a substantially right angle at an intermediate portion. The connection terminal 60A in the approximate L-shape explained above has an insertion piece part 61A and the entwining part 62A. Specifically, the insertion piece part 61A is a part which extends in the width direction (the Y-direction) of the connection terminal 60A and is also a part that projects to the connector hole of the connector connection part 40A explained above. Further, the entwining part 62A is a part that extends in a vertical direction (the Z-direction). This entwining part 62A is also a part to which an end of the wire 51A is entwined.

Further, the case 90A covers the entirety of the antenna device 10A, and has a cylindrical shape for covering the coil 50A and the bobbin member 30A explained above. Further, it is also possible that the case 90 has a mounting portion to which an external equipment/device is attached.

Method for Manufacturing of the Antenna Device 10A

When the antenna device 10A that has the configuration explained above is manufactured, the bobbin member 30A is formed by injection molding, and separately, the connection terminal 60A is formed by press-forming. Further, after the bobbin member 30A is formed, the connection terminal 60A is located at the terminal mounting part 35A and is inserted in the connector hole of the connector connection part 40A so as to be projected from the connector hole (corresponding to an insertion process of the connection terminal).

Prior to or after the above insertion process, the core 20A is attached to the core insertion part 34A (corresponding to a core insertion process). After the core 20A is attached, the wire 51A is wound around the winding frame part 32A so as to form the coil 50A (corresponding to a coil formation process). In this coil formation process, when the wire 51A for the lower layer is wound, the wire 51A is densely/tightly wound until the wire 51A reaches the partition 33A. As a result, the tight winding portion 53A on the lower layer is formed.

After the tight winding portion 53*a* is formed, the wire 51A is continuously and loosely wound around the winding frame part 32A from the partition 33A to the other end side (the X2 side) of the winding frame part 32A in the longitudinal direction (the X-direction). As a result, the loose winding portion 54A on the lower layer is formed. When the loose winding portion 54A on the side of the lower layer is formed, the winding is performed in a state in which a comparatively large gap S1 exists between the adjacent turns of the wire 51A.

Further, after the wire 51A reaches the other end side (the X2 side) of the winding frame part 32A in the longitudinal direction (the X-direction), the wire 51A is continuously and loosely wound around the winding frame part 32A toward the partition 33A in a state in which a winding direction is opposite to a winding direction of the wire 51A to form the lower layer. Therefore, the wire 51A of the upper layer is wound in a state of crossing (intersecting) with respect to the wire 51A of the lower layer.

Before or after the coil 50A is formed, one end of the wire 51A is entwined to a tip side of the entwining part 62A of one connection terminal 60A1 of the connection terminals 60A. Further, after the coil 50A is formed, the other end of the wire 51A is entwined to the entwining part 62A of another connection terminal 60A2 of the connection terminals 60A. After these ends of the wire 51A are entwined, the entwined parts explained above are fixed by, for instance, a dip method of soldering.

After the antenna device 10A is manufactured, it may be necessary to adjust an inductance value L thereof. This inductance value L can be obtained by using the following formula.

$$L=k\times\mu o\times\pi\times a^2\times n^2/b \quad (1)$$

In regards to the above-mentioned formula, "k" corresponds to Nagaoka coefficient, "μo" corresponds to magnetic permeability, "a" correspond to a radius of the coil, "n" corresponds to the number of turns, and "b" corresponds to a coil length.

When the inductance value L is adjusted in the loose winding portion 54A, the wire 51A is moved in a direction in which a coil length "b" is shortened (that is, distances (intervals) of the pitches P1-Pn and the pitches SP1-SPm are shortened) by using a tool. In other words, in the loose winding portion 54A, the wire 51A is slid toward a location where the gap S1 at the predetermined portion becomes narrow. As a result, the inductance value L can be adjusted to a slightly increased inductance value. Further, when the tool is used for adjusting an inductance value, it is preferred that the loose winding portion 54A is provided at an end side of the antenna device 10A. In other words, when the tight winding portion 53A is provided at the end side of the antenna device 10Aa, and further, the loose winding portion 54A is provided between the tight winding portion 53A, and the terminal mounting part 35A and the connector connection part 40A, there is a possibility that the inductance adjustment work by using the tool is difficult to perform. This is because such as the barrier wall 35A2, a frame wall of the terminal mounting part 35A and the connector connection part 40A, and other parts become an obstacle for the inductance adjustment work. Therefore, in order to increase inductance adjustment work efficiency, it is preferred that the loose winding portion 54A is provided at the end side of the antenna device 10A.

Further, when a fine adjustment is performed in the loose winding portion 54A, it is preferred that the adjacent turns of the wire 51A are separated by a predetermined distance as much as possible. Therefore, it is preferred that a length of the loose winding portion 54A is equal to or more than a length of the tight winding portion 53A in the X-direction. Further, it is further preferred that the length of the loose winding portion 54A is equal to the length of the tight winding portion in the X-direction.

Effects of First Embodiment

As discussed above, the antenna device 10A is configured with the core 20A, the bobbin member 30A, and the coil 50A. Specifically, the bobbin member 30A is provided at the outer circumferential side of the core 20A, and at the same time, has the partition 33A in a position located between both ends of the bobbin member 30*a* in the longitudinal direction. The coil 50 is formed by winding the wire 51A around the bobbin member 30A. Further, the coil 50A is configured with the tight winding portion 53A and the loose winding portion 54A. Specifically, the tight winding portion 53A is formed by densely winding the wire 51A with a dense winding density around one part of the bobbin member 30A located between the one end side (the X1 side) of the bobbin member 30A and the partition 33A. The loose winding portion 54A is formed by loosely winding the wire 51A with a loose winding density around the other part of the bobbin member 30A located between the partition 33A and the other end side (the X2 side) of the bobbin member 30A. Further, the first layer (the lower layer) and the second layer (the upper layer) are provided at the loose winding portion 54A. Also, because the winding directions of the first and second layers are different, the wire 51A composing the first layer and the wire 51A composing the second layer are stacked on each other so as to cross each other.

As explained above, the wire 51A that composes the first layer (the lower layer) and the wire 51A that composes the second layer (the upper layer) are stacked on each other so as to cross (intersect) each other in the loose winding portion 54A. Therefore, it is easy to make the wire 51A of the second layer (the upper layer) slide relative to the wire 51A of the first layer (the lower layer). As a result, it becomes possible to easily adjust an inductance value even though it has a simple configuration.

The antenna device 10A according to the embodiments of the present invention does not need to use a separate/additional magnetic substance core such as the second magnetic substance core as disclosed in Japanese Patent Number 5050223. Further, a second coil wound around the second magnetic substance core also does not need to be used. Therefore, it becomes possible to simplify the configuration for adjusting an inductance value.

In the first embodiment of the present invention, the terminal mounting part 35A to which the connection terminal 60A is attached is provided at the one end side (the X1 side) of the bobbin member 30A. Further, the tight winding portion 53A is provided at a side that is close to the terminal mounting part 35A relative to the loose winding portion 54A. Therefore, it is possible to obtain a configuration in which the wire 51A of the second layer (the upper layer) can be easily slid.

That is, when the loose winding portion 54A is provided at the side that is close to the terminal mounting part 35A relative to the tight winding portion 53A, the loose winding portion 54A does not have an end portion where it is possible to freely access to the coil 50A because the loose winding portion 54A including the end portion is sandwiched between the terminal mounting part 35A and the tight winding portion 53A. Therefore, in this hypothetical case, the wire 51A of the second layer (the upper layer) of the loose winding portion 54A would be difficult to slide. On the other hand, as discussed in the above embodiment, when the tight winding portion 53A is provided at the side that is close to the terminal mounting part 35A relative to the loose winding portion 54A, the wire 51A of the second layer (the upper layer) of the loose winding portion 54A is easy to slide because the loose winding portion 54A has the end portion where it is possible to freely access the coil 50A at the other end side (the X2 side). As a result, it becomes possible to easily adjust the inductance value.

Further, in the first embodiment of the present invention, in regards to the loose winding portion 54A, the wire 51A that composes the first layer (the lower layer) and the wire 51A that composes the second layer (the upper layer) are located in a single layer along the sidewall part 32A1 of the bobbin member 30A. That is, the wire 51A that composes the first layer (the lower layer) and the wire 51A that composes the second layer (the upper layer) are located adjacent to one another in a single (common) layer without stacking onto or crossing each other. Therefore, on the top surface 32A2 and the bottom surface 32A3 of the winding frame part 32A, the intervals of the adjacent turns of the wire 51A of the first layer (the lower layer) and the intervals of the adjacent turns of the wire 51A of the second layer (the upper layer) can be comparatively large because the wire 51A that composes the first layer (the lower layer) and the wire 51A that composes the second layer (the upper layer) are stacked and cross each other. As a result, the configuration in which the adjustment of the inductance value can be easily performed can be realized.

Further, in the sidewall part 32A1, when the wire 51A of the second layer (the upper layer) is slid, in which a slide distance exceeds the gap S1, the adjacent wire 51A of the first layer (the lower layer) can also be slid. As a result, for instance, it becomes possible to prevent a winding collapse of the coil 50A that can occur by sliding only the wire 51A of the second layer (the upper layer). Further, a position of the wire 51A after sliding should be fixed with respect to the coil 50A. Specifically, both the wires 51A (the turns of the wire 51A) of the second and first layers come into contact with the sidewall part 32A1. Therefore, because of a winding force of the coil 50A and a frictional force between the wires 51A (the turns of the wire 51A) and the sidewall part 32A1, the position of the wire 51A after sliding can be easily adjusted without providing an extra fixing structure for the wire 51A.

Further, in the first embodiment of the present invention, each of the wire 51A of the first layer (the lower layer) and the wire 51A of the second layer (the upper layer) can cross the width direction (the Y-direction) perpendicular to the longitudinal direction (the X-direction) of the bobbin member 30A at an angle range of 3° to 177°. In the configuration explained above, the wire 51A of the second layer (the upper layer) crosses the wire 51A of the first layer (the lower layer) at an angle range of 6° to 174°. Therefore, the configuration in which the wire 51A of the second layer (the upper layer) can be easily formed on (cross) an upper side of the wire 51A of the first layer (the lower layer) can become realized.

In the first embodiment of the present invention, a length of the loose winding portion 54A can be longer than a length of the tight winding portion 53A in the X-direction. In this case, the intervals between the adjacent turns of the wire 51A can be provided more than a predetermined distance in the loose winding portion 54A. As a result, the fine adjustment of the inductance value L can become easily performed.

Further, in the first embodiment of the present invention, the length of the loose winding portion 54A can also be the same as the length of the tight winding portion 53A in the X-direction. In this case, while securing a predetermined inductance value L or more in the tight winding portion 53A, the fine adjustment of the inductance value L can be performed in the loose winding portion 54A.

In the first embodiment of the present invention, a distance between the adjacent turns of the wire 51A of the loose winding portion 54A that are located closest to the other end side (the X2 side) is different from a distance between the adjacent turns of the wire 51A of the loose winding portion 54A that are located closest to the one end side (the X1 side) (the partition 33A) in the longitudinal direction (the X-direction) of the bobbin member 30A. Therefore, it can also be possible that while moving (sliding) the wire 51A of the loose winding portion 54A that is located closest to the other end side (the X2 side), the wire 51A of the loose winding portion 54A that is located closest to the one end side (the X1 side) (the partition 33A) is not moved (slid). In this case, when only the wire 51A, which is located closest to the other side (the X2 side) of the core 20A and which is close to an end of the core 20A, is moved (slid), it becomes possible to increase the influence to the distribution of the magnetic flux.

Further, in the first embodiment of the present invention, a distance (pitch) between the adjacent turns of the wire 51A of the loose winding portion 54A that are located closest to the other end side (the X2 side) can be shorter than a distance between the adjacent turns of the wire 51A of the loose winding portion 54A that are located closest to the one end side (the X1 side) (the partition 33A) in the longitudinal direction (the X-direction) of the bobbin member 30A. Further, in this case, when the wire 51A that is located closest to the other end side (the X2 side) is moved (slid), the fine adjustment of the inductance value L can be performed.

Second Embodiment

An antenna device 10B according to a second embodiment of the present invention will be explained below with reference to the drawings. Further, in the second embodiment of the present invention, redundant explanations with respect to the same configurations as the antenna device 10A in the first embodiment of the present invention explained above are omitted. However, the alphabetic character "B" instead of the alphabetic character "A" that is used in the first embodiment is added to an end of each reference numeral. Thus, a configuration that has the alphabetic character "B" relates to the second embodiment of the present invention. Therefore, though explanations and illustrations are omitted in the second embodiment, the same configuration as the antenna device 10A in the first embodiment may also be explained by adding the alphabetic character "B".

Figure 8:
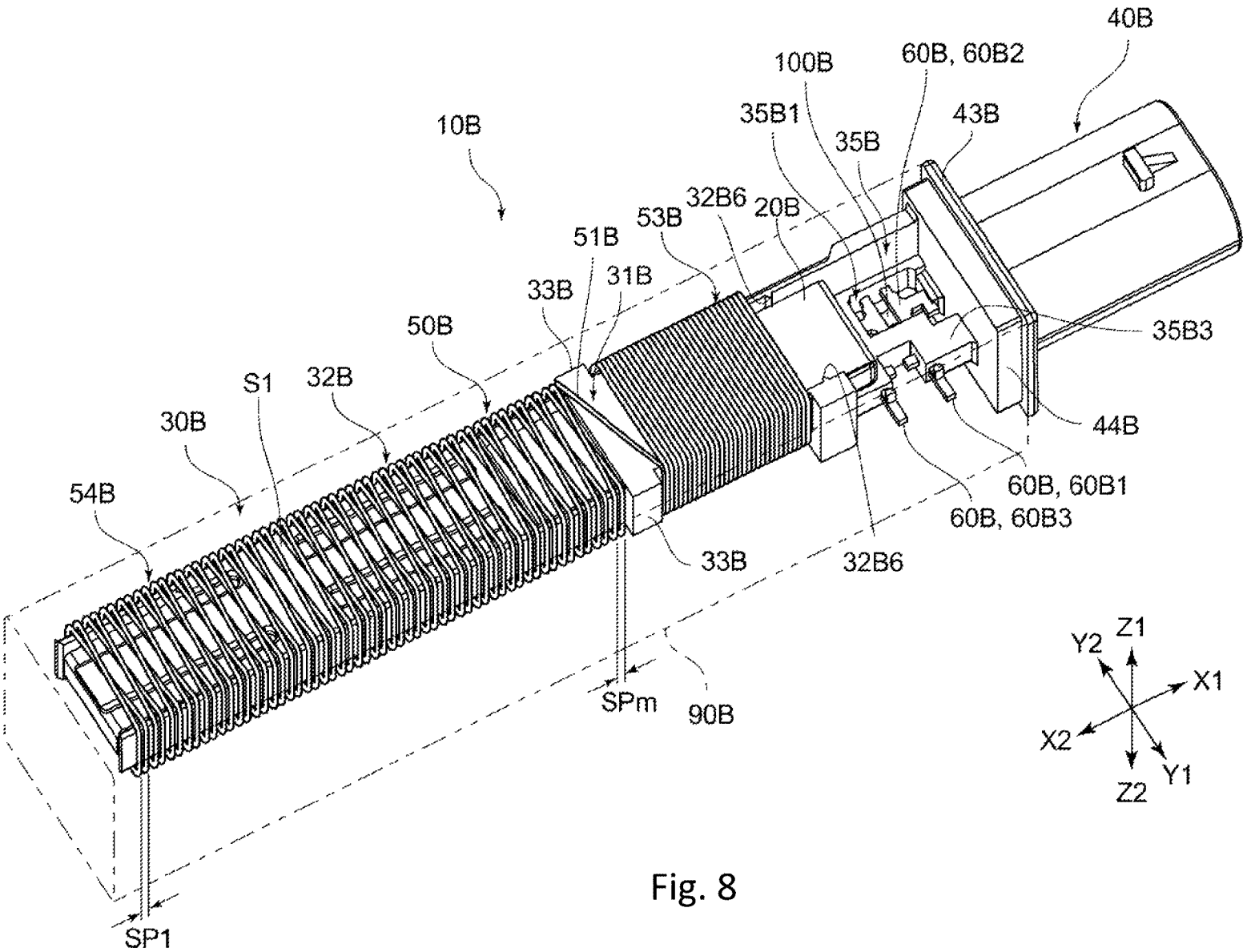
FIG. 8 is a perspective view that shows a configuration of an antenna device according to a second embodiment of the present invention.
Figure 9:
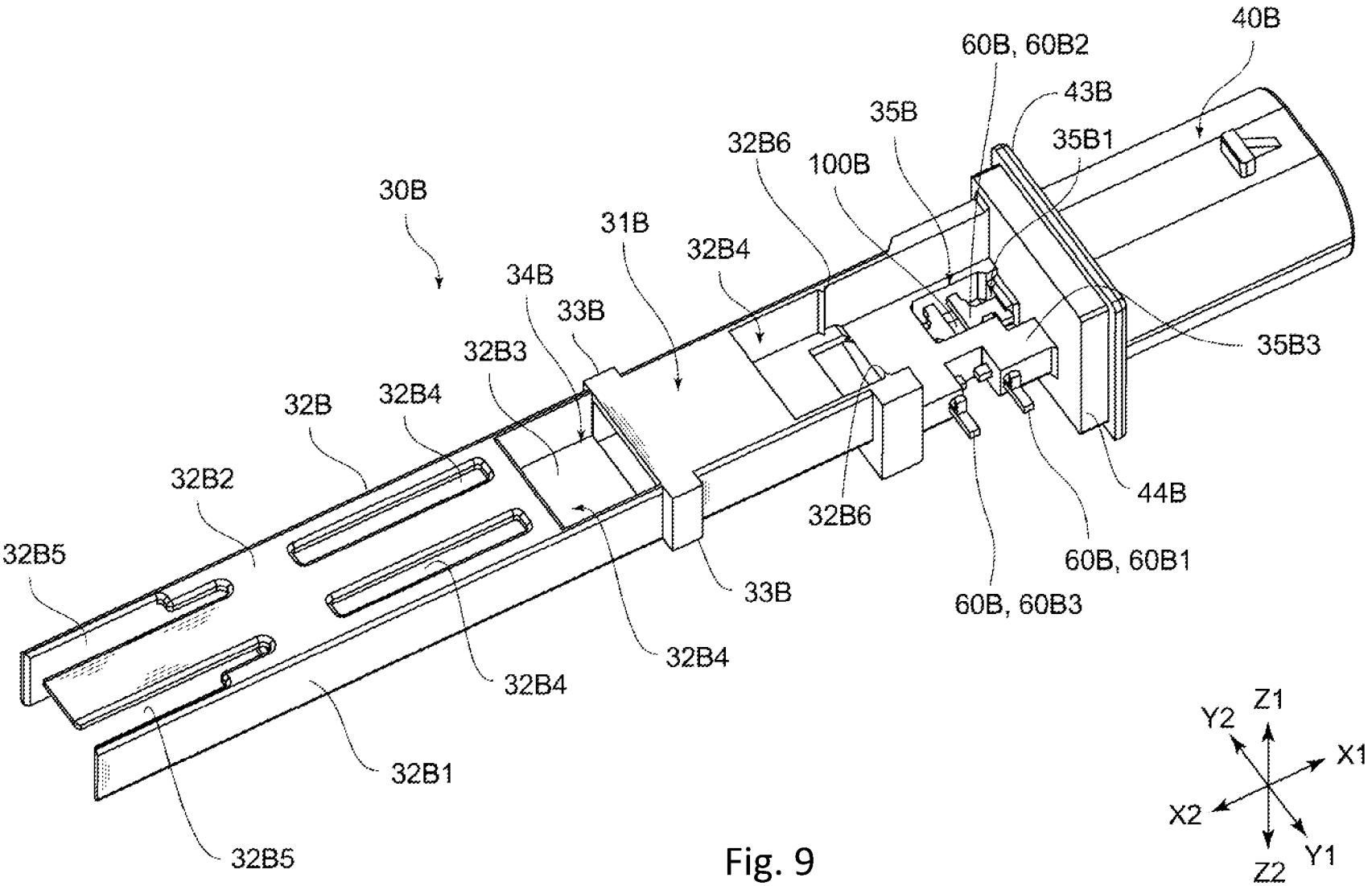
FIG. 9 is a perspective view that shows a configuration of a bobbin member and a connection terminal of the antenna device shown in FIG. 8 according to the second embodiment of the present invention.

FIG. 8 is a perspective view that shows a configuration of the antenna device 10B according to the second embodiment of the present invention. FIG. 9 is a perspective view that shows a configuration of a bobbin member 30B and a connection terminal 60B of the antenna device 10B shown in FIG. 8. The configuration of a relative locational feature of a terminal mounting part 35B of the antenna device 10B according to the second embodiment of the present invention is different from the configuration of a relative locational feature of the terminal mounting part 35A of the antenna device 10A according to the first embodiment of the present invention. Further, the configuration of a connector connection part 40B of the antenna device 10B according to the second embodiment of the present invention is different from the configuration of the connector connection part 40A of the antenna device 10A according to the first embodiment of the present invention.

Figure 10:
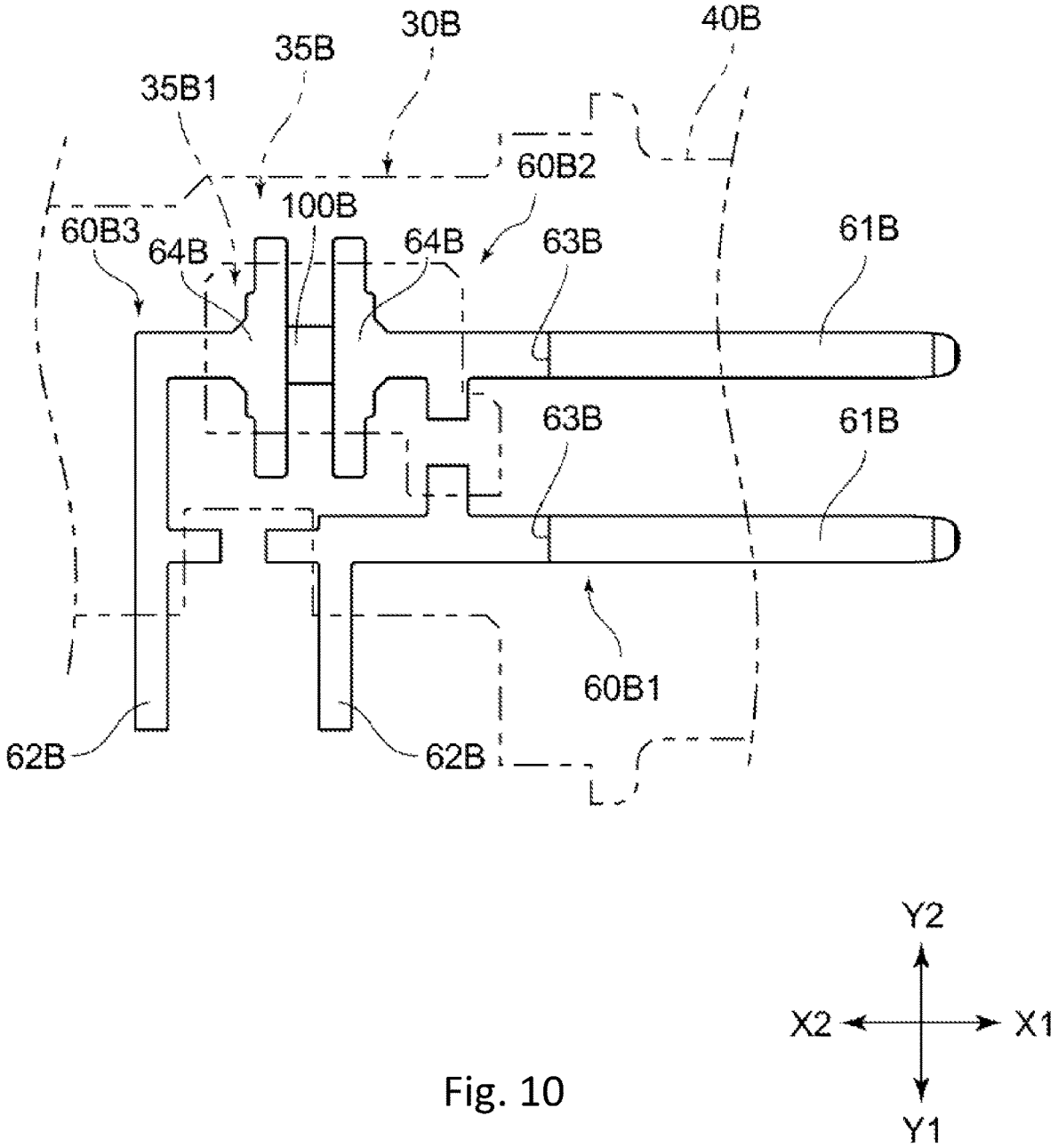
FIG. 10 is a plan view that shows shapes of three connection terminals that the antenna device has shown in FIG. 8 according to the second embodiment of the present invention.

Specifically, the terminal mounting part 35B has three connection terminals 60B in all, not a pair of the connection terminals 60A in the first embodiment. Specifically, the connection terminals 60B1, 60B2 and 60B3 exist. FIG. 10 is a plan view that shows shapes of the three connection terminals 60B1, 60B2 and 60B3. As shown in FIG. 10, among the three connection terminals 60B, the connection terminal 60B1 is located at a near side (the Y1 side) in a width direction (the Y-direction). Further, the connection terminal 60B2 is located at a far side (the Y2 side) in the width direction (the Y-direction) relative to the connection terminal 60B1. The connection terminal 60B3 is located at the other end side (the X2 side) in the longitudinal direction (the X-direction) relative to the connection terminals 60B1 and 60B2.

The connection terminal 60B1 has an insertion piece part 61B, an entwining part 62B, and a vertical (up and down) extension part 63B. The insertion piece part 61B extends in the longitudinal direction (the X-direction) and is the same as the insertion piece part 61A explained above. Therefore, one side (the X1 side) of the insertion piece part 61B projects inside the connector hole of the connector connection part 40B and can be electrically connected to the external connector that is inserted in the connector hole.

Further, one end of the wire 51B is entwined to the entwining part 62B in the same manner as the entwining part 62A explained above. The vertical extension part 63B extends in an up-and-down direction (the Z-direction). Therefore, positions of the insertion piece part 61B and the entwining part 62B in a height direction (the Z-direction) are different from each other.

The connection terminal 60B2 has the insertion piece part 61B and a chip support piece part 64B. The insertion piece part 61B has the same configuration as the insertion piece part 61B of the connection terminal 60B1. A dimension in the width direction (the Y-direction) of the chip support piece part 64B is larger than that of the insertion piece part 61B. Though both ends of the chip support piece part 64B enter into a resin portion of the bobbin member 30A, a part between both ends is exposed to an opening 35B1. One side of a chip type capacitor 100B is attached to this chip support piece part 64B in a state of being electrically connected.

The connection terminal 60B3 has the entwining part 62B and the other chip support piece part 64B. The other end of the wire 51B is entwined to the entwining part 62B. Further, the other side of the chip type capacitor 100B is attached to this chip support piece part 64B in a state of being electrically connected.

In the terminal mounting part 35B, the connection terminal 60B is provided in order not to project to an upper side (the Z1 side) from a (inner) bottom surface 32B3 of a bobbin part 31B (See FIG. 9). A bottom wall 35B3 of the terminal mounting part 35B is thicker than the bottom surface 32B3 to achieve the configuration explained above. Further, parts of the connection terminals 60B1-60B3 explained above are embedded into the bottom wall 35B3 by, for instance, an insert molding.

The bobbin member 30A of the antenna device 10A according to the first embodiment of the present invention has the barrier wall 35A2 that separates the terminal mounting part 35A from the core insertion part 34A. However, the bobbin member 30B according to the second embodiment of the present invention does not have a configuration that corresponds to a barrier wall. As shown in FIG. 9, the connection terminals 60B do not project to the upper side (the Z1 side) upper than the bottom surface 32B3. Therefore, a core 20B can move to a side of the terminal mounting part 35B.

Further, in the same manner as the core 20A of the first embodiment explained above, the core 20B is held in a core insertion part 34B by core holding projections 32B6 and an inner wall of the bobbin part 31B by being wound with the wire in the other end side (the X2 side).

Unlike the connector connection part 40A of the first embodiment, the connector connection part 40B is provided along the longitudinal direction (the X-direction). Further, a flange part 43B is provided at a boundary between the terminal mounting part 35B and the connector connection part 40B. In the second embodiment of the present invention, the flange part 43B is in a rectangular plate-like shape. Further, a step part 44B is provided at an outer circumferential edge of the flange part 43B. With this configuration, an opening edge of a case 90B is fitted into this step part 44B.

Effects of Second Embodiment

The antenna device 10B according to the second embodiment of the present invention also become possible to develop the same effects as the antenna device 10A according to the first embodiment of the present invention explained above.

Further, in the second embodiment of the present invention, the barrier wall 35A2 does not exist in the bobbin member 30B, and in addition, the connection terminal 60B does not project to the upper side (the Z1 side) farther than the bottom surface 32B3. Therefore, the core 20B can be slid to the side of the terminal mounting part 35B inside of the core insertion part 34B. As a result, it becomes possible to increase and decrease (when sliding of the core 20B is not performed at a side of the loose winding portion 54B, in particular, an inductance value decreases) an inductance value by sliding the core 20B in addition to the previously described inductance adjustment method, i.e., an inductance value is adjusted by sliding the wire 51B of a first layer (an upper layer) in a loose winding portion 54B.

Variation

Although the first and second embodiments of the present invention are explained above, the antenna device and the method for manufacturing the antenna device may be varied in many ways as explained below.

In the first embodiment of the present invention explained above, an electronic component is not attached between the pair of the connection terminals 60A, however, the same can also be attached. Further, in the second embodiment of the present invention explained above, though the chip type capacitor 100B is attached as an electronic component, other electronic components such as a resistor can also be attached. Further, as an electronic component, any of a surface-mounting type or a pin type can be used.

Further, in the first and second embodiments explained above, the loose winding portions 54A and 54B are located at the other end side (the X2 side) in the longitudinal direction (the X-direction) and the tight winding portions 53A and 53B are located at the one end side (the X1 side) in the longitudinal direction (the X-direction). However, a locational configuration is not limited to the above configuration. Specifically, the loose winding portions 54A and 54B can also be located at the one end side (the X1 side) in the longitudinal direction (the X-direction) and the tight winding portions 53A and 53B can also be located at the other end side (the X2 side) in the longitudinal direction (the X-direction).

Further, a plurality of the loose winding portions 54A and 54B can be provided. Thus, the tight winding portions 53A and 53B can be located between the plurality of the loose winding portions 54A and 54B, respectively. Similarly, a plurality of the tight winding portions 53A and 53B can be provided. Thus, the loose winding portions 54A and 54B can be located between the plurality of the tight winding portions 53A and 53B, respectively.

Further, in the first and second embodiments explained above, only one of the cores 20A and 20B is respectively provided. However, a plurality of cores can also be provided. Further, in regards to the bobbin member, as long as it is capable of forming the tight winding portion and the loose winding portion, any configuration can also be adopted. Further, any number of the connection terminals can be adopted. Further, any configuration (shape and size) of the connection terminals can also be adopted.

The antenna device and the method for manufacturing of the antenna device being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. An antenna device comprising:

a magnetic core;

a bobbin having first and second ends opposite to each other, the bobbin housing the core;

a coil provided by winding a wire around the bobbin; and a terminal mounting part, to which a terminal is attachable, that is provided at the first end of the bobbin, wherein the coil is configured with a plurality of winding portions, the plurality of winding portions is configured with:

a tight winding portion located next to the first end of the bobbin; and a loose winding portion located next to the second end of the bobbin, wherein the tight winding portion is located closer to the terminal mounting part than the loose winding portion, a winding density of the tight winding portion in which the wire is densely wound is larger than a winding density of the loose winding portion in which the wire is loosely wound, wherein the loose winding portion is configured with a first loose winding area and a second loose winding area, and the first loose winding area is located closer to the tight winding portion than the second loose winding area, and first distances between every two immediately adjacent winding portions in the first loose winding area are the same, and a second distance between two immediately adjacent winding portions in the second loose winding area is different from the first distance.

2. The antenna device according to claim 1, wherein the loose winding portion includes a double layer along a first part of the bobbin, the double layer including a lower layer of turns formed of a first winding layer wrapped in a first direction and an upper layer of turns formed of a second winding layer wrapped in a second direction crossing the lower layer of turns.

3. The antenna device according to claim 2, wherein in the loose winding portion, the wire of the first winding layer and the wire of the second winding layer are provided in a double layer along major surfaces of the bobbin.

4. The antenna device according to claim 2, wherein in the loose winding portion, the wire of the first winding layer and the wire of the second winding layer are provided in a single layer along a second part of the bobbin.

5. The antenna device according to claim 4, wherein in the loose winding portion, the wire of the first winding layer and the wire of the second winding layer are provided in a single layer along minor surfaces of the bobbin.

6. The antenna device according to claim 2, wherein the bobbin is elongated in a longitudinal direction, and both the wire of the first winding layer and the wire of the second winding layer cross a width direction perpendicular to the longitudinal direction at an angle of 3° to 177°.

7. The antenna device according to claim 1, further comprising:

a partition at a position located between the first and second ends;

wherein the tight winding portion and the loose winding portion are separated by the partition.

8. The antenna device according to claim 1, wherein a first wound wire pitch between first adjacent turns of the wire of the loose winding portion closest to the first end of the bobbin is different from a second wound wire pitch between second adjacent turns of the wire of the loose winding portion closest to the second end of the bobbin.

9. The antenna device according to claim 1, wherein the bobbin is elongated in a longitudinal direction, and a length of the loose winding portion in the longitudinal direction is equal to or longer than a length of the tight winding portion in the longitudinal direction.

10. A method for manufacturing an antenna device, the antenna device having:

a magnetic core;

a bobbin housing the core, the bobbin having first and second ends opposite to each other;

a coil that is provided by winding a wire around the bobbin; and a terminal mounting part, to which a terminal is attachable, the method comprising:

inserting the core into the bobbin; and forming the coil by winding the wire around the bobbin, the winding including:

densely winding the wire around a first area of the bobbin located closer to the terminal mounting part than a loose winding portion, so as to form a tight wound portion; and loosely winding the wire around a second area of the bobbin located between the tight wound portion and the second end of the bobbin so as to form the loose wound portion further away from the terminal mounting part than the tight wound portion, wherein the loose winding portion is configured with a first loose winding area and a second loose winding area, and the first loose winding area is located closer to the tight winding portion than the second loose winding area, and first distances between every two immediately adjacent winding portions in the first loose winding area are the same, and a second distance between two immediately adjacent winding portions in the second loose winding area is different from the first distance.

11. A method for manufacturing an antenna device according to claim 10, wherein the loosely winding includes:

forming a first winding layer by winding the wire in a first wire winding direction; and after the first winding layer is formed, forming a second winding layer by winding the wire in a second wire winding direction opposite to the first wire winding direction on the first wire at a first part of the bobbin so that the wire of the first layer and the wire of the second layer cross each other.

12. The method for manufacturing an antenna device, according to claim 11, wherein the loosely winding includes the wire of the first winding layer and the wire of the second winding layer that are provided in a double layer along major surfaces of the bobbin.

13. The method for manufacturing an antenna device, according to claim 11, wherein the wire of the first winding layer and the wire of the second winding layer are provided in a single layer along a second part of the bobbin.

14. The method for manufacturing an antenna device according to claim 13, wherein the wire of the first winding layer and the wire of the second winding layer are provided in a single layer along minor surfaces of the bobbin.

15. The method for manufacturing an antenna device, according to claim 11, wherein the bobbin is elongated in a longitudinal direction, and both the wire of the first winding layer and the wire of the second winding layer cross a width direction perpendicular to the longitudinal direction at an angle of 3° to 177°.

16. The method for manufacturing an antenna device, according to claim 11, wherein a length of the loose winding portion in the longitudinal direction is equal to or longer than a length of the tight winding portion in the longitudinal direction.

17. The method for manufacturing an antenna device, according to claim 10, wherein a first wound wire pitch between first adjacent turns of the wire of the loose winding portion closest to the first end of the bobbin is different from a second wound wire pitch between second adjacent turns of the wire of the loose winding portion closest to the second end of the bobbin.

18. The method for manufacturing an antenna device, according to claim 17, wherein after the winding of the wire, an inductance adjustment step is performed by making a distance of the first wound wire pitch smaller than the second wound wire pitch.

* * * * *